US009132429B2

(12) United States Patent
Greve et al.

(10) Patent No.: US 9,132,429 B2
(45) Date of Patent: Sep. 15, 2015

(54) CAPPED SHREDDER KNIFE

(71) Applicant: Zenith Cutter, Inc., Loves Park, IL (US)

(72) Inventors: Timothy R. Greve, Davis, IL (US); Douglas Long, Rockford, IL (US); Robert F. Yocum, Rockford, IL (US)

(73) Assignee: Zenith Cutter, Inc., Loves Park, IL (US)

( * ) Notice: Subject to any disclaimer, the term of this patent is extended or adjusted under 35 U.S.C. 154(b) by 86 days.

(21) Appl. No.: 14/065,569

(22) Filed: Oct. 29, 2013

(65) Prior Publication Data

US 2014/0217222 A1 Aug. 7, 2014

Related U.S. Application Data

(60) Provisional application No. 61/761,947, filed on Feb. 7, 2013.

(51) Int. Cl.

| | |
|---|---|
| ***B02C 18/18*** | (2006.01) |
| *B02C 13/18* | (2006.01) |
| *B02C 13/28* | (2006.01) |

(52) U.S. Cl.

CPC ..... *B02C 18/18* (2013.01); *B02C 13/1814* (2013.01); *B02C 13/28* (2013.01)

(58) Field of Classification Search

CPC .... B02C 13/1814; B02C 2/10; B02C 18/186; B02C 13/28; B02C 13/04; B02C 2013/2808; B02C 18/18; B02C 13/09; D21D 1/02

USPC ..... 241/189.1, 195, 197, 242, 243, 291, 241/293, 294, 300

See application file for complete search history.

(56) References Cited

U.S. PATENT DOCUMENTS

| | | | | |
|---|---|---|---|---|
| 2,647,695 | A * | 8/1953 | Rogers | 241/197 |
| 5,454,671 | A | 10/1995 | Qvarth | |
| 6,517,020 | B1 * | 2/2003 | Smith | 241/294 |
| 6,662,837 | B2 | 12/2003 | Smith | |
| 6,837,453 | B2 | 1/2005 | Sturm | |
| 7,121,771 | B2 | 10/2006 | Englund | |
| 7,434,756 | B2 | 10/2008 | Sotsky | |
| 7,959,099 | B1 | 6/2011 | Cox et al. | |
| 8,061,642 | B2 | 11/2011 | Chang | |
| 2007/0158478 | A1 * | 7/2007 | Stager | 241/91 |
| 2011/0290920 | A1 * | 12/2011 | Kim et al. | 241/25 |
| 2012/0205473 | A1 | 8/2012 | Friz | |
| 2012/0305691 | A1 | 12/2012 | Roy et al. | |
| 2012/0325950 | A1 | 12/2012 | Davis et al. | |
| 2013/0082131 | A1 | 4/2013 | Haalisto | |

FOREIGN PATENT DOCUMENTS

| | | |
|---|---|---|
| DE | 9421212 | 8/1995 |
| DE | 202008007222 | 9/2008 |
| DE | 202009004859 | 8/2009 |
| WO | 2005021158 | 3/2005 |

* cited by examiner

*Primary Examiner* — Faye Francis
*Assistant Examiner* — Onekki Jolly
(74) *Attorney, Agent, or Firm* — Michael Best & Friedrich LLP

(57) ABSTRACT

A knife assembly for a shredder includes a base and a knife cap coupled to the base. The knife cap is configured to cut a material passed through the shredder. In addition, a brazing material is positioned between the base and the knife cap to secure the base and the knife cap together. The base and the knife cap have generally the same outer footprint.

16 Claims, 6 Drawing Sheets

CAPPED SHREDDER KNIFE

BACKGROUND

The present invention relates to knives for shredders.

With reference to FIGS. 1-3, a shredder 10 known in the prior art includes a rotating drum 14 located near the bottom of a hopper 18. Knives 22 are mounted to the drum 14 on knife holders 26, and as the drum 14 rotates, the knives 22 cut against a stationary bed knife 30 mounted to the hopper 18. Material (e.g., carpet) is fed into the hopper 18 and the material is cut as it passes between the drum 14 and the bed knife 30. With reference to FIG. 3, the knives 22 include a central threaded bore 34 for a fastener 36 to attach the knives 22 to the knife holders 26. When installed, the corners of the knives 22 and the corresponding bed knife 30 act as the primary cutting surfaces. Once a corner of the knife 22 is worn, the knife 22 is removed, rotated and re-installed with a different corner acting as the primary cutting surface. The knives 22 are an all steel body and need to be replaced often due to excessive wear. Alternatively, with reference to FIGS. 4A-4B, cutting tips 38, known in the prior art, can be added to the corners of knife bodies 42, 46 to improve the operating life of knives 50, 54. The cutting tips 38 are typically made of harder material than the knife bodies 42, 46 (e.g., carbides). However, the cutting tips 38 themselves, and more specifically the bond between the cutting tips 38 and the knife bodies 42, 46, are subject to failure. Sometimes fasteners 56 are used to secure the cutting tips 38 to the knife bodies 42 (FIG. 4A). Alternatively, the cutting tips 38 have been individually brazed to the knife bodies 46 (FIG. 4B). The knives 50 and 54 include discontinuities between the tips 38 and the knife bodies 42, 46. The discontinuities result in less effective cutting surfaces, subjected to increased wear and shortened operational life.

SUMMARY

In one embodiment, the invention provides a knife assembly for a shredder, the knife assembly including a base and a knife cap coupled to the base. The knife cap is configured to cut a material passed through the shredder. In addition, a brazing material is positioned between the base and the knife cap to secure the base and the knife cap together. The base and the knife cap have generally the same outer footprint.

In another embodiment the invention provides a method of manufacturing a knife assembly for a shredder. The method includes providing a base and a knife cap. The base and the knife cap have generally the same outer footprint. The method also includes positioning a brazing material between the base and the knife cap, and heating the brazing material between the base and the knife cap to form a bond between the base and the knife cap. The method forms a unified knife assembly.

In another embodiment the invention provides a knife assembly for a shredder, the knife assembly including a base having a threaded bore extending therethrough and a projection at least partially defining the bore. In addition the knife assembly includes a knife cap coupled to the base and configured to cut a material passed through the shredder. The knife cap includes a recess sized and configured to receive the projection on the base. In addition, the knife assembly includes a shim positioned between the base and the knife cap. The shim includes an aperture through which the projection on the base extends, and the shim has a brazing material thereon such that the knife cap is secured to the shim and the shim is secured to the base via brazing. The base and the knife cap have generally the same square outer footprint.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
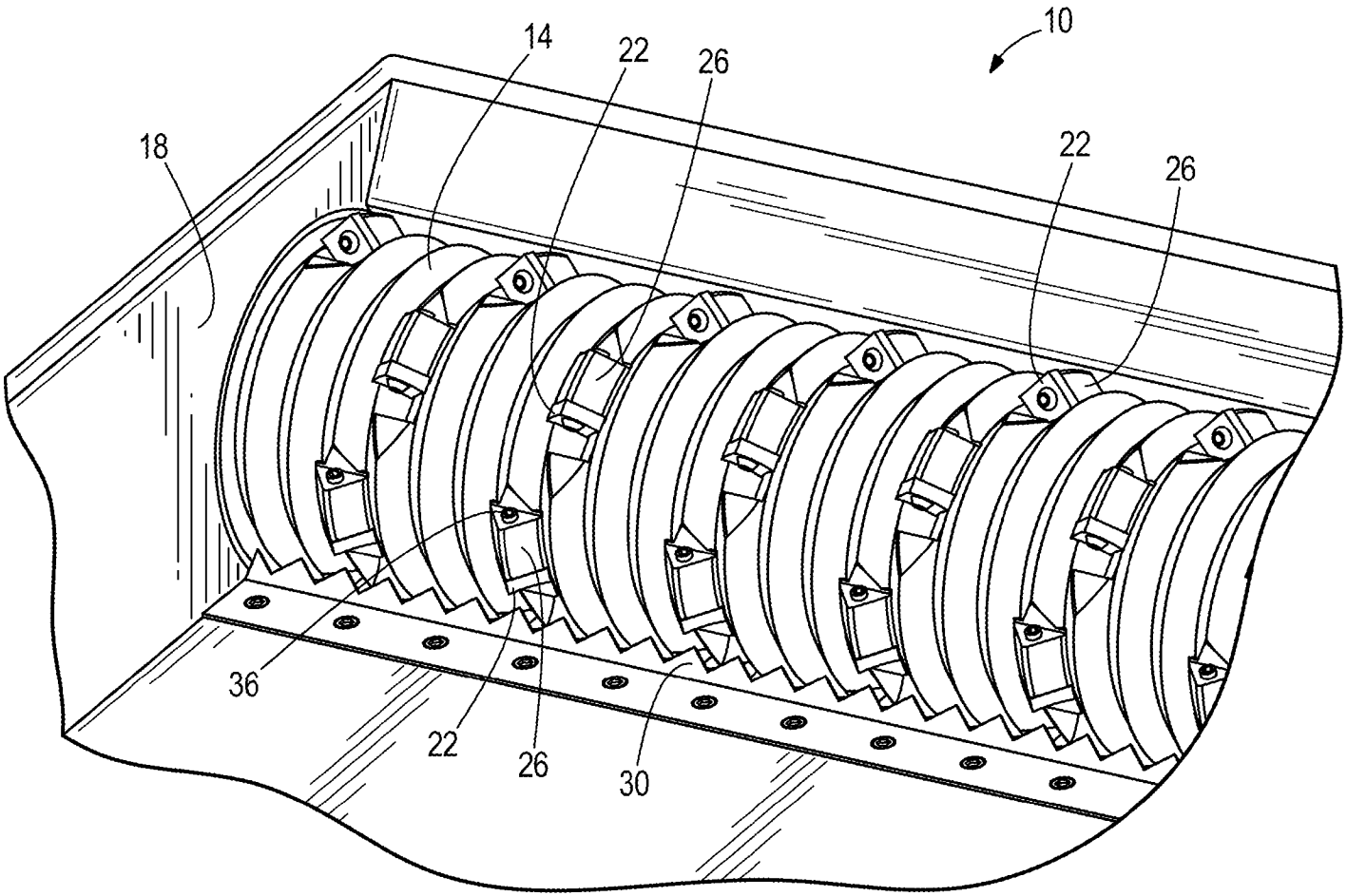
FIG. 1 PRIOR ART
FIG. 1 is a partial perspective view of a shredder with a plurality of knives known in the prior art.
Figure 2:
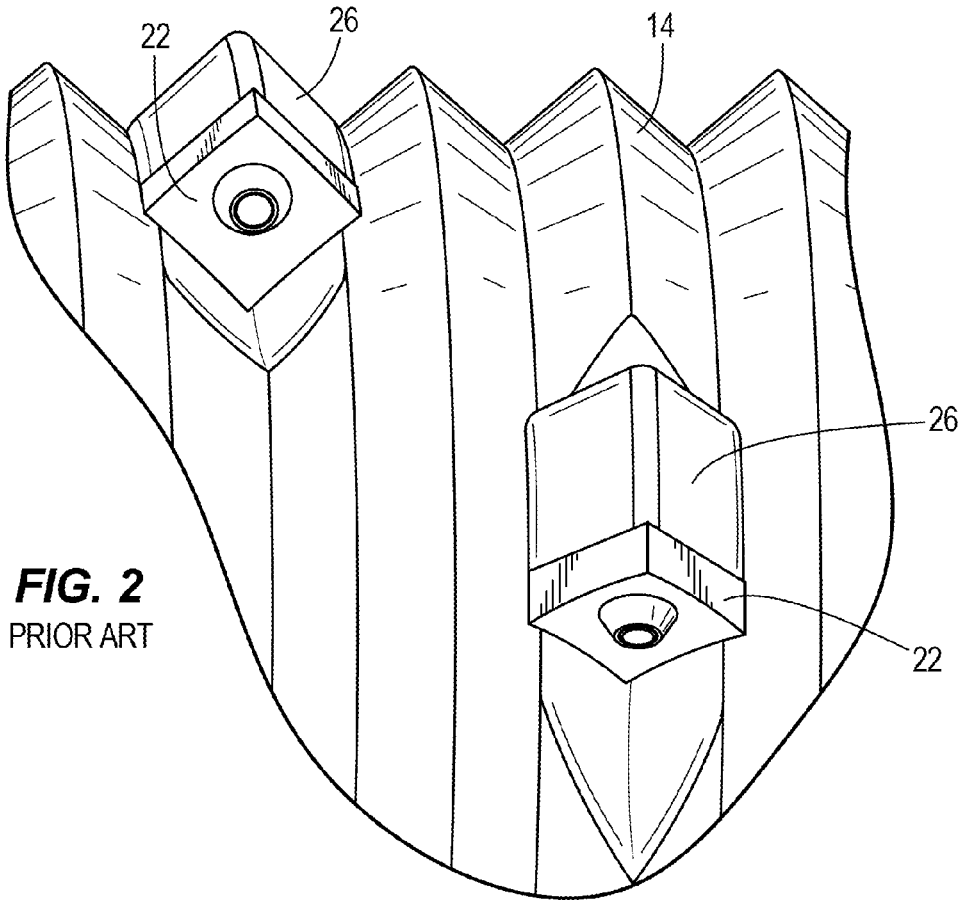
FIG. 2 PRIOR ART
FIG. 2 is an enlarged perspective view of the shredder and knives of FIG. 1.
Figure 3:
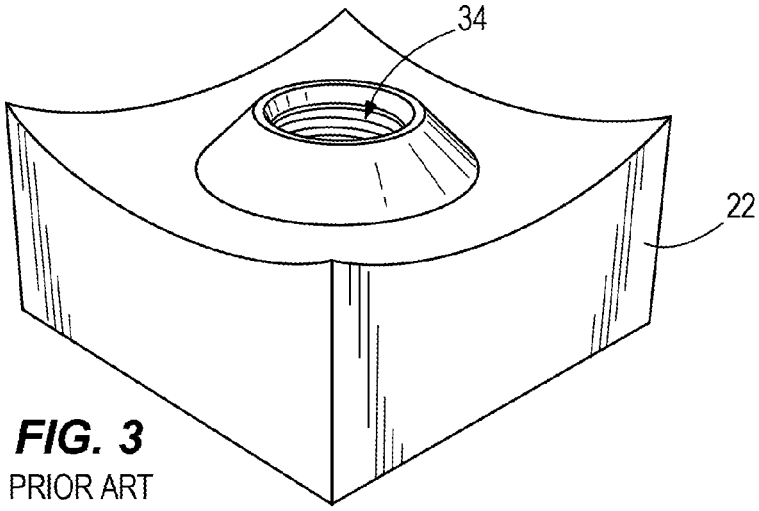
FIG. 3 PRIOR ART
FIG. 3 is a perspective view of the knife of FIG. 1.
Figure 4A:
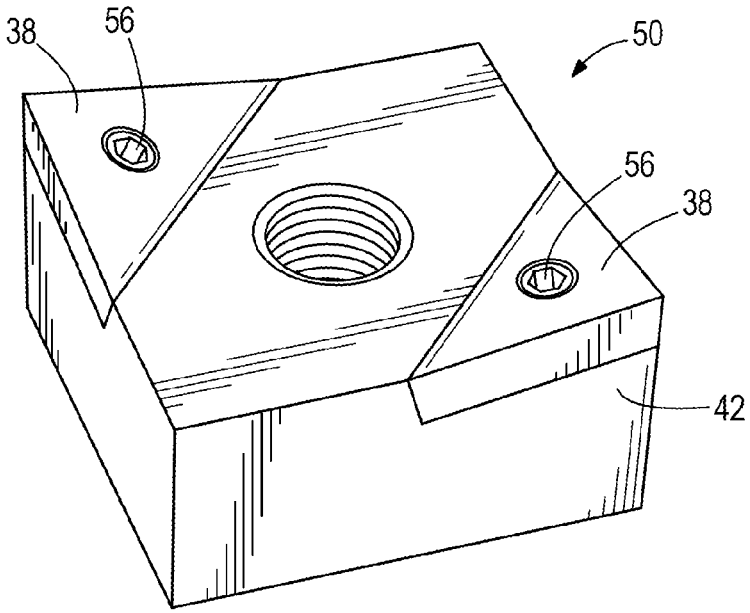
FIG. 4A PRIOR ART
FIG. 4A is a perspective view of another knife known in the prior art to be used with the shredder of FIG. 1.
Figure 4B:
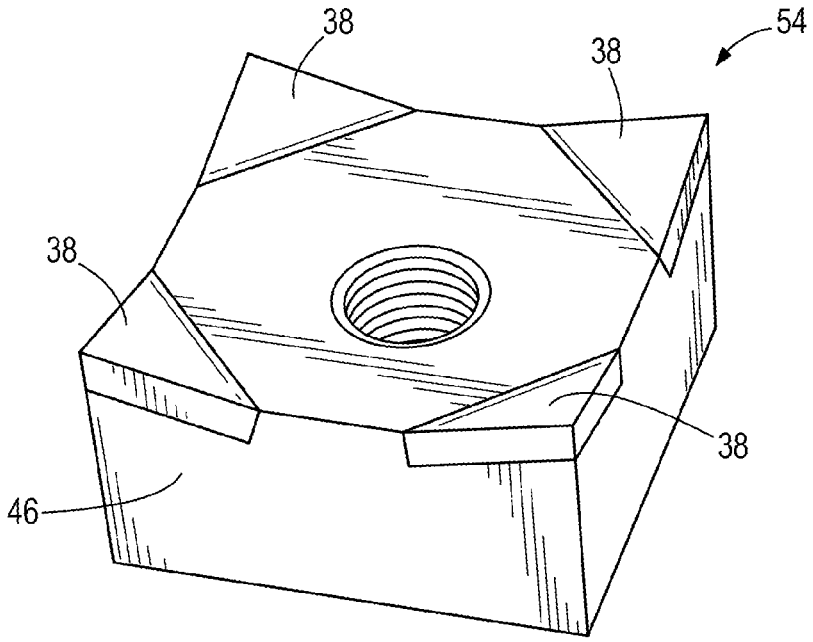
FIG. 4B PRIOR ART
FIG. 4B is a perspective view of another knife known in the prior art to be used with the shredder of FIG. 1.
Figure 5A:
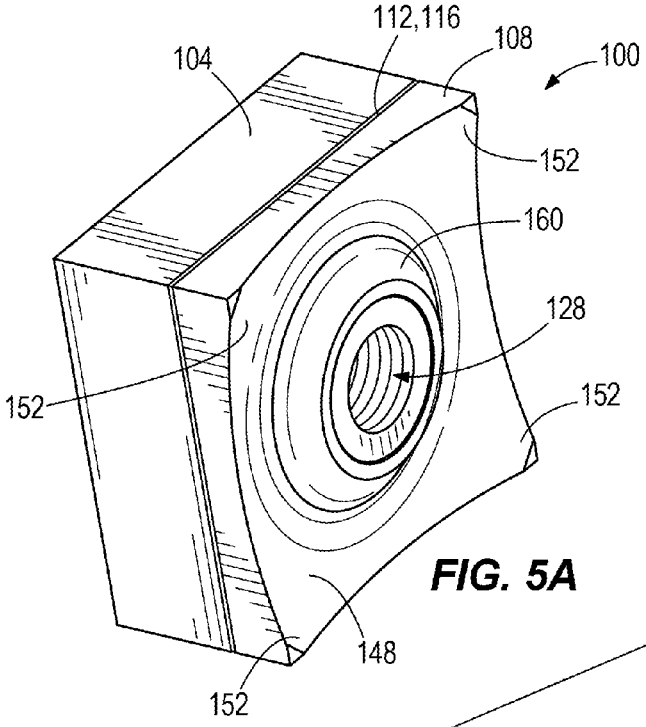
FIG. 5A is a perspective view of a knife assembly according to the present invention.
Figure 5B:
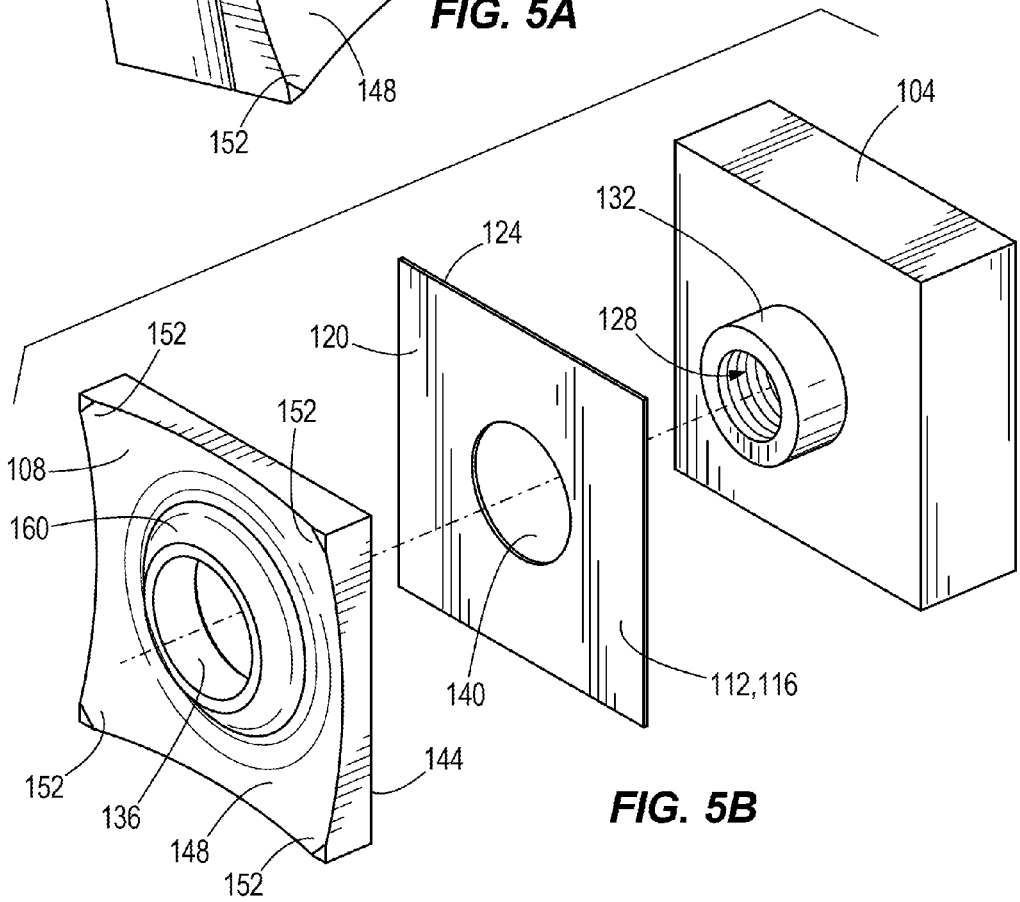
FIG. 5B is an exploded view of the knife assembly of FIG. 5A.

With reference to FIGS. 5A-5B, a knife assembly 100 according to an embodiment of the present invention includes a base 104 and a knife cap 108 coupled to the base 104. The knife assembly 100 is coupled to the knife holder 26 on the drum 14 of the shredder 10 via a fastener 36, and the knife cap 108 is configured to cut material (e.g., carpet) as the material is passed through the shredder 10. The knife cap 108 and the base 104 are secured together with a brazing material 112 positioned between the base 104 and the knife cap 108, for example, on a shim 116. The knife cap 108 and the base 104 have generally the same outer footprint (i.e., the knife cap 108 and the base 104 have generally the same square peripheral shape). This eliminates the problems associated with using smaller inserts or tips, such as the cutting tips 38 of FIGS. 4A and 4B discussed above. The knife cap 108 therefore provides a continuous cutting surface.

The shim 116 may be formed of, for example, copper, and includes a first surface 120 and an oppositely facing second surface 124. The first surface 120 and the second surface 124 include the brazing material 112 embedded thereon. The brazing material 112 is positioned between the base 104 and the knife cap 108, and is heated to form a bond between the base 104 and the knife cap 108. In other words, the knife cap 108 is secured to the first surface 120 of the shim 116 and the base 104 is secured to the second surface 124 of the shim 116. Following the heating of the brazing material 112, the base 104 and the knife cap 108 form the unified knife assembly 100.

The base 104 includes a threaded bore 128 to enable the knife assembly 100 to be mounted to a knife holder 26 on the drum 14 via a fastener 36. In addition, the base 104 also includes a projection 132 that partially defines the bore 128. The projection 132 extends into a similarly sized recess, in the form of a bore, 136 formed in the knife cap 108, and the shim 116 includes an aperture 140 through which the projection 132 on the base 104 extends. When the projection 132 is received in the recess 136 formed in the knife cap 108, the projection 132 provides load-bearing support to the brazing material 112 bond between the knife cap 108 and the base 104. The threaded projection 132 also eliminates the need to machine threads into the knife cap 108, which when using a hard material like carbide, is very difficult and expensive.

The knife cap 108 has a first surface 144 in facing relationship to the base 104, and a second surface 148 oppositely facing from the first surface 144. The second surface 148 partially defines corners 152 that correspond to preferred cutting locations of the knife assembly 100. In addition, the second surface 148 extends arcuately and in a concave manner between two adjacent corners 152. The knife cap 108 includes the bore 136 extending between the first surface 144 and the second surface 148, and a truncated conical region 160 adjacent the bore 136.

The base 104 is made from a first material (e.g., steel) and the knife cap 108 is made from a second material (e.g., a carbide). The second material of the knife cap 108 is harder than the first material of the base 104. The knife cap 108 can be made from, for example, tungsten carbide or other carbides. The base 104 has a thickness measured in a direction perpendicular to the first surface 144 of the knife cap 108 that is at least two times a thickness of the knife cap 108 measured in a similar perpendicular direction.

In operation, the unified knife assembly 100 is coupled to the knife holder 26 on the drum 14 to operate the shredder 10. Making the knife cap 108 from tungsten carbide or other materials harder than the steel base 104 provides a hard cutting surface with increased operating life corresponding to reduced shredder 10 downtime. Since the knife cap 108 has the same outer footprint as the base 104, there is a larger surface area to which the knife cap 108 can bond to the base 104 via the brazing material 112. The large surface area over which the brazing material 112 is bonding the knife cap 108 and the body 104 provides an improved, unified assembly. Making the base 104 from relatively inexpensive steel provides cost savings and the steel is easily machined to include threads in the bore 128 for mounting to the knife holder 26 with the fastener 36.

Figure 6:
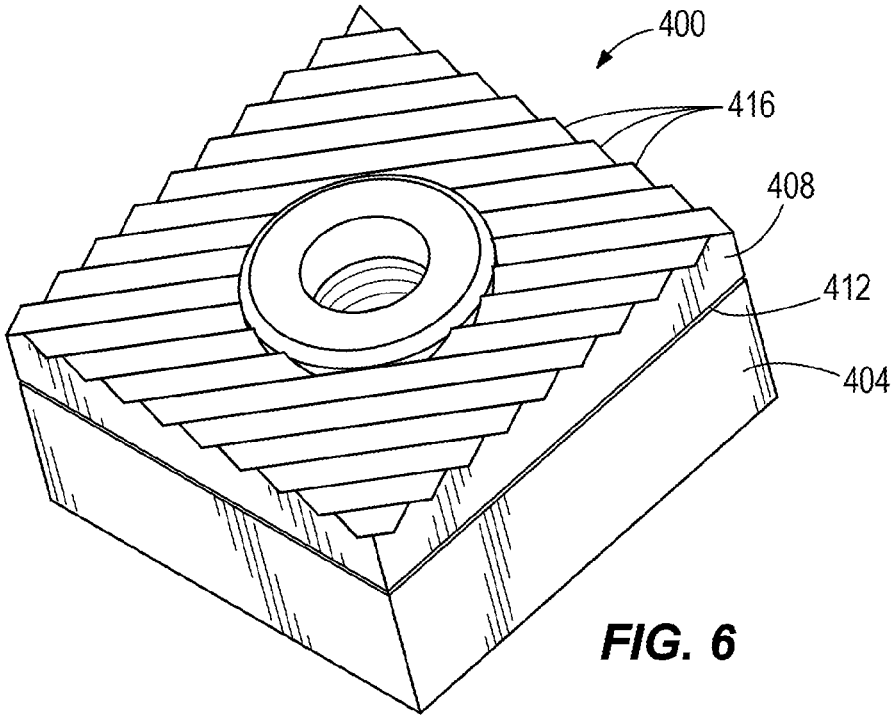
FIG. 6 is a perspective view of a knife assembly according to another embodiment of the invention.
Figure 7:
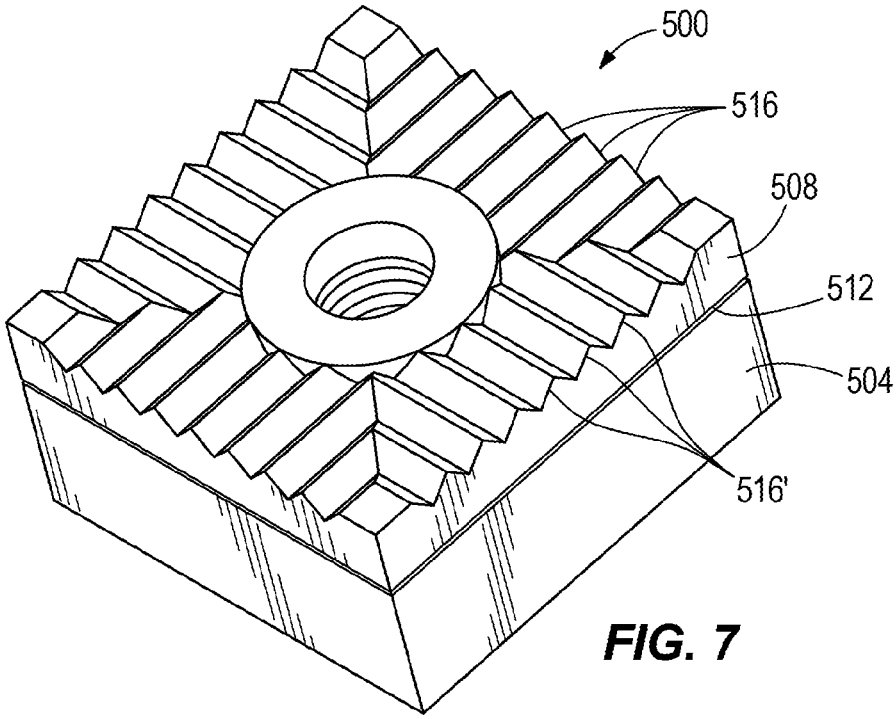
FIG. 7 is a perspective view of a knife assembly according to another embodiment of the invention.

With reference to FIG. 6, a knife assembly 400 according to another embodiment of the invention is presented. The knife assembly 400 is similar to the knife assembly 100 with only the differences discussed herein. The knife assembly 400 includes a base 404, a knife cap 408, and a brazing material 412 positioned therebetween. The knife cap 408 includes a plurality of horizontal serrations 416 formed thereon. The horizontal serrations 416 are all formed in the same direction. With reference to FIG. 7, a knife assembly 500 according to another embodiment of the invention is presented. The knife assembly 500 is similar to the knife assembly 100 with only the differences discussed herein. The knife assembly 500 includes a base 504, a knife cap 508, and a brazing material 512 positioned therebetwen. The knife cap 508 includes a plurality of perpendicular serrations 516, 516' formed such that the serrations 516, 516' are perpendicular to the bed knife 30 when performing a cutting action. The serrations 516 are oriented perpendicularly to the serrations 516'.

Figure 8:
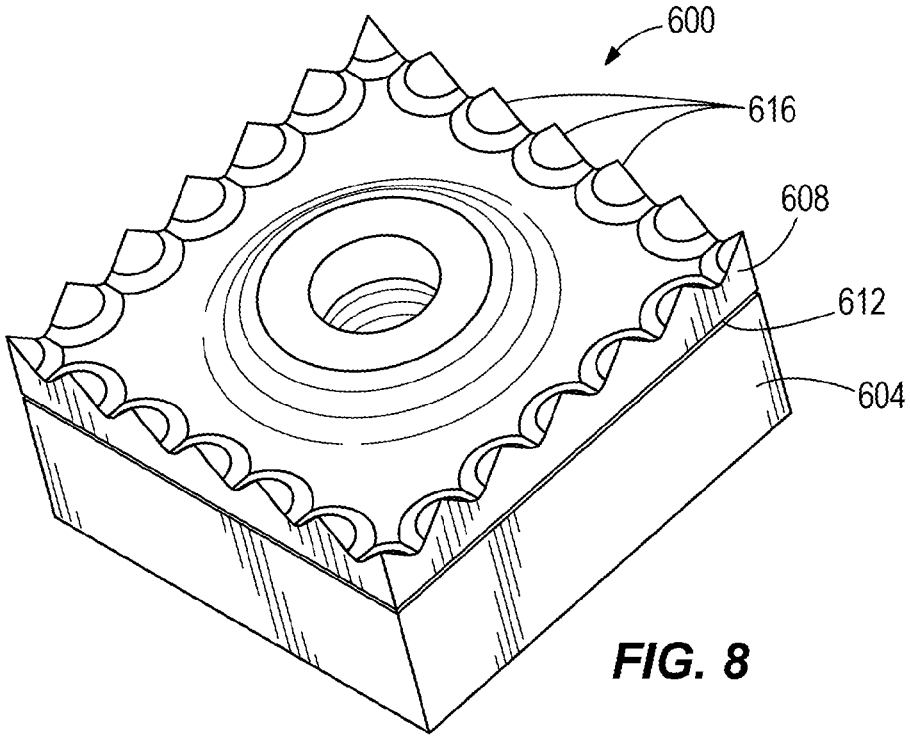
FIG. 8 is a perspective view of a knife assembly according to another embodiment of the invention.
Figure 9:
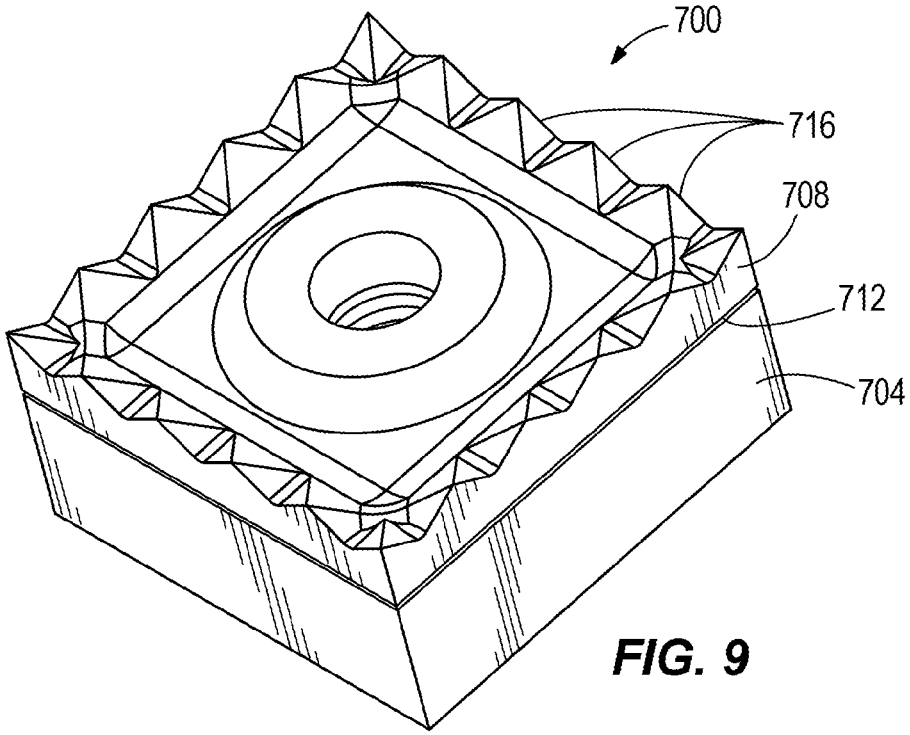
FIG. 9 is a perspective view of a knife assembly according to another embodiment of the invention.

With reference to FIG. 8, a knife assembly 600 according to another embodiment of the invention is presented. The knife assembly 600 is similar to the knife assembly 100 with only the differences discussed herein. The knife assembly 600 includes a base 604, a knife cap 608, and a brazing material 612 positioned therebetween. The knife cap 608 includes a plurality of half-cone-shaped serrations 616 formed thereon. With reference to FIG. 9, a knife assembly 700 according to another embodiment of the invention is presented. The knife assembly 700 is similar to the knife assembly 100 with only the differences discussed herein. The knife assembly 700 includes a base 704, a knife cap 708, and a brazing material 712 positioned therebetwen. The knife cap 708 includes a plurality of half-pyramid-shaped serrations 716 formed thereon.

Alternative knife cap constructions with alternative cutting geometries forming the second surface are considered within the scope of the present invention. Various features and advantages of the invention are set forth in the following claims.

What is claimed is:

1. A knife assembly for a shredder, the knife assembly comprising:

a base;

a knife cap coupled to the base, the knife cap configured to cut a material passed through the shredder; and a brazing material positioned between the base and the knife cap to secure the base and the knife cap together, wherein the base and the knife cap have generally the same outer footprint;

wherein the base includes a bore extending therethrough, the bore being threaded; and wherein the base further includes a projection at least partially defining the bore, the projection sized and configured to be received in a mating recess in the knife cap.

2. The knife assembly of claim 1, further comprising a shim containing the brazing material positioned between the base and the knife cap.

3. The knife assembly of claim 2, wherein the shim has oppositely facing first and second surfaces, each having the brazing material thereon such that the knife cap is secured to the shim and the shim is secured to the base via brazing.

4. The knife assembly of claim 1, further comprising a shim containing the brazing material positioned between the base and the knife cap, the shim including an aperture through which the projection on the base extends.

5. The knife assembly of claim 1, wherein the knife cap defines a first surface in facing relationship to the base, and a second surface oppositely facing from the first surface, the second surface at least partially defining corners that each define a preferred cutting location of the knife assembly, and wherein the second surface extends arcuately and in a concave manner between at least two adjacent corners.

6. The knife assembly of claim 5, wherein the recess in the knife cap is a bore extending between the first and second surfaces, the second surface defining a truncated conical region adjacent the bore.

7. The knife assembly of claim 1, wherein the base is made from a first material and the knife cap is made from a second material, the second material being harder than the first material.

8. The knife assembly of claim 7, wherein the first material is steel and the second material is a carbide.

9. The knife assembly of claim 8, wherein the carbide is tungsten carbide.

10. The knife assembly of claim 1, wherein the base has a thickness that is at least two times a thickness of the knife cap.

11. The knife assembly of claim 1, wherein the knife cap includes serrations.

12. The knife assembly of claim 11, wherein the serrations are all formed in the same direction.

13. The knife assembly of claim 11, wherein the serrations include a first set of serrations and a second set of serrations oriented perpendicularly to the first set of serrations.

14. The knife assembly of claim 11, wherein the serrations are formed as half-cone-shaped serrations.

15. The knife assembly of claim 11, wherein the serrations are formed as half-pyramid-shaped serrations.

16. A knife assembly for a shredder, the knife assembly comprising:

a base having a threaded bore extending therethrough and a projection at least partially defining the bore;

a knife cap coupled to the base, the knife cap configured to cut a material passed through the shredder and including a recess sized and configured to receive the projection on the base; and a shim positioned between the base and the knife cap, the shim having an aperture through which the projection on the base extends, the shim having a brazing material thereon such that the knife cap is secured to the shim and the shim is secured to the base via brazing, wherein the base and the knife cap have generally the same square outer footprint.

* * * * *